US006009580A

United States Patent [19]

Caminade et al.

[11] Patent Number: 6,009,580

[45] Date of Patent: Jan. 4, 2000

[54] METHOD AND APPARATUS FOR SUPPORTING AN ELEMENT TO BE SUPPORTED, IN PARTICULAR THE BODY OF A PATIENT, MAKING IT POSSIBLE TO SUPPORT SAID ELEMENT AT A PREDETERMINED FLOAT LINE

[75] Inventors: Jean-Luc Caminade, Saint Jean de Vedas; Jean-Marc Montant, Montpellier, both of France

[73] Assignee: Support Systems International Industries, Montpellier Cedex 5, France

[21] Appl. No.: 08/995,183

[22] Filed: Dec. 22, 1997

[30] Foreign Application Priority Data

Dec. 23, 1996 [FR] France ..... 96 15848

[51] Int. Cl.[7] ..... A47C 27/10; A47C 31/12; A47C 7/057

[52] U.S. Cl. ..... 5/713; 5/710

[58] Field of Search ..... 5/713, 710, 714, 5/715, 671, 672

[56] References Cited

U.S. PATENT DOCUMENTS

| | | | |
|---|---|---|---|
| 4,873,737 | 10/1989 | Savenije | 5/710 |
| 5,170,364 | 12/1992 | Gross et al. | 5/713 |
| 5,283,735 | 2/1994 | Gross et al. | 5/713 |
| 5,560,374 | 10/1996 | Viard | 5/713 |
| 5,815,864 | 10/1998 | Sloop | 5/713 |

FOREIGN PATENT DOCUMENTS

| | | |
|---|---|---|
| 0 489 310 | 6/1992 | European Pat. Off. . |
| 0 676 158 | 10/1995 | European Pat. Off. . |

*Primary Examiner*—Alexander Grosz
*Attorney, Agent, or Firm*—Wolf, Greenfield & Sacks, P.C.

[57] ABSTRACT

The present invention relates to a method and apparatus for supporting a body element. The apparatus includes at least one support device with at least one closed or controlled-release chamber, a filling device and an emptying means device for filling said chamber with a filling fluid and emptying the fluid from the chamber, and a distance-measurement device for measuring the distance between a top face and a bottom face of the chamber. The apparatus further includes a reaction-measurement device for measuring the reaction of the support device relative to the morphological data of the body element to be supported, and a control system including a combination device for combining the measurement of the penetration distance d provided by the distance-measurement device and the measurement of the reaction provided by the reaction-measurement device. This combination is advantageously constituted by summing the two obtained measurements. The invention makes it possible to support the element to be supported substantially in a position of equilibrium corresponding substantially to a predetermined float line.

18 Claims, 7 Drawing Sheets

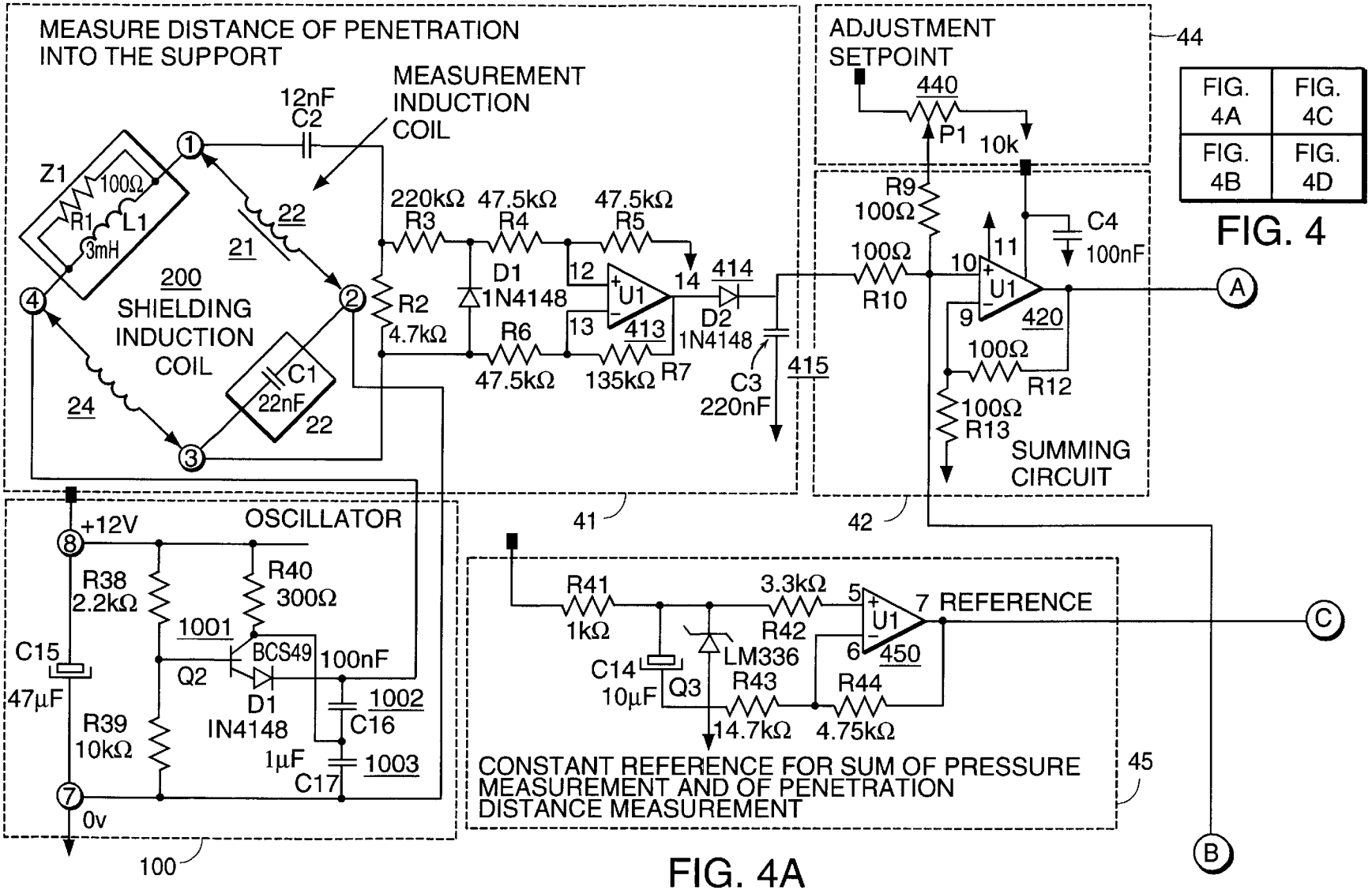
FIG. 4A
FIG. 4B
FIG. 4C
FIG. 4D
FIG. 4
ADJUSTMENT SETPOINT
440
P1 10k
44
C4 100nF
U1 420
R9 100Ω
R10 100Ω
R12 100Ω
R13 100Ω
SUMMING CIRCUIT
42
A
B
C
7 REFERENCE
U1 450
R41 1kΩ
R42 3.3kΩ
R43 14.7kΩ
R44 4.75kΩ
LM336
Q3
C14 10μF
CONSTANT REFERENCE FOR SUM OF PRESSURE MEASUREMENT AND OF PENETRATION DISTANCE MEASUREMENT
45
MEASURE DISTANCE OF PENETRATION INTO THE SUPPORT
MEASUREMENT INDUCTION COIL
12nF C2
Z1
R1 100Ω
L1 3mH
21
22
24
200 SHIELDING INDUCTION COIL
C1 22nF
R2 4.7kΩ
R3 220kΩ
R4 47.5kΩ
R5 47.5kΩ
R6 47.5kΩ
R7 135kΩ
D1 1N4148
D2 1N4148
C3 220nF
414
415
413
U1
41
OSCILLATOR
R40 300Ω
BCS49
Q2
D1 IN4148
100nF
1001
1002 C16
1003 C17
1μF
R38 2.2kΩ
R39 10kΩ
C15 47μF
+12V
0v
100

METHOD AND APPARATUS FOR SUPPORTING AN ELEMENT TO BE SUPPORTED, IN PARTICULAR THE BODY OF A PATIENT, MAKING IT POSSIBLE TO SUPPORT SAID ELEMENT AT A PREDETERMINED FLOAT LINE

The invention relates to a method and apparatus for supporting an element to be supported, in particular the body of a patient, whereby the element to be supported can be supported in a position of equilibrium essentially corresponding to a predetermined "float line" of said element.

BACKGROUND OF THE INVENTION

Support devices are well known for supporting elements to be supported, in particular the bodies of patients who are confined to bed or have to be kept still for prolonged periods, in which case such devices are generally mainly known as mattresses. It is also well known that confining such patients to bed or keeping them still for prolonged periods leads to complications, in particular bedsores.

Therefore, in the prior art, various devices have been proposed for distributing the weight of the patient over an interface body area in contact with the support device that is as large as possible so as to keep the interface pressures below pressures at which capillaries become occluded, or even, in therapeutic devices, so as to stimulate re-vascularization of tissue.

For example, Document FR-A-2 707 874 discloses a mattress designed in particular to prevent decubitus ulcers and provides at least one closed or controlled-release flexible chamber that is inflatable under a pressure that is a function of the maximum penetration distance to which the element to be supported is allowed to penetrate into the support element, the penetration distance being designed to be set and to be approximately in the range 12 cm to 17 cm. That prior document therefore makes provision for the filling or emptying means to be servo-controlled so as to fill or to deflate said chamber until the extent of penetration is brought to approximately the set penetration distance. The penetration distance is measured by means of a capacitive device referenced 9, 10 which can be seen clearly in FIGS. 1 and 4 of Document FR-A-2 707 874.

Furthermore, in Document FR-A-2 718 347=EP-A-676 158 the Applicant describes a method and a system for supporting an element to be supported, in particular the body of a patient, making it possible to support the element at an essentially constant controlled penetration depth by using a measurement device for measuring the penetration distance, the measurement means differing from those of the preceding document by the fact that they comprise a metal element in the form of a thin film placed in the vicinity of the top face of the support element and combined with an inductive device forming a position detector secured to the bottom face of the support element. Similarly, provision is made to servo-control filling or deflating the chamber of the support element so as to achieve the pre-set penetration distance regardless of the weight of the element to be supported, in particular the body of a patient.

For most patients, the prior art solutions offer a good weight/body area ratio, i.e. they distribute well the weight of the patient over the support device, but they suffer from the drawback of not systematically bringing the penetration of the body of every patient accurately to a level of natural equilibrium that procures the ideal weight/body area distribution ratio.

OBJECTS AND SUMMARY OF THE INVENTION

Therefore, of the present invention makes it possible to support an element to be supported, in particular the body of a patient, essentially in a position of natural equilibrium which substantially corresponds to a "float line" that is preferably predefined.

The present invention also enables supporting a patient, so as to obtain expected performance levels as regards preventing or treating complications related to prolonged periods of being confined to bed or of being kept still, and in particular as a function of the morphological characteristics of the immersed/apparent portion, in particular the weight and the body area, and more generally the weight and the area of the element to be supported.

The present invention also makes it possible to analyze and to control the extent to which an element to be supported, in particular the body of a patient, penetrates into the support device, and the reaction that said support device exerts on the element to be supported, in particular the body of a patient, so that optimum pressures are applied to the body area in contact with the support device, which is particularly desirable when preventing and treating complications related to prolonged periods of being confined to bed or of being kept still, in particular bedsores.

For the first time, the present invention provides a solution to all of the above-mentioned technical problems in a manner that is cheap, reliable and safe, easy to implement, and useable industrially and medically.

In a first aspect, the present invention provides a method of supporting an element to be supported, in particular the body of a patient, said method consisting in providing at least one support device comprising at least one closed or controlled-release chamber that is flexible and inflatable, said chamber having a top face and a bottom face; filling means and emptying means for filling said chamber with a filling fluid and for emptying said fluid from said chamber being provided together with distance-measurement means for measuring the distance between said top face and said bottom face, wherein a reaction-measurement device is further provided for measuring the reaction of the support device relative to the morphological data of the element to be supported, wherein the penetration distance to which the element to be supported penetrates into the support device is measured, the reaction of the support device to penetration of the element to be supported is measured, and the two measurements are combined so as to bring the element to be supported substantially to a position of equilibrium corresponding substantially to a predetermined "float line".

In an advantageous implementation of the method, the above-mentioned combination of the measurement of the penetration distance and of the measurement of the reaction of the support device consists in summing the two values.

In another variant implementation, the measurement of the reaction of the support device consists in measuring the pressure in said chamber at said measured penetration distance.

In another variant implementation, the above-mentioned summing consists in summing the value of the penetration distance and the value of the pressure in the chamber.

In another variant implementation, the above-mentioned combination of the value of the penetration distance and of the value of the reaction measurement is compared with a reference value characterizing the equilibrium value for penetration of the element to be supported corresponding substantially to the predetermined float line of said element to be supported.

In another variant implementation, the above-mentioned reference value that is predetermined and that defines the equilibrium corresponding substantially to the float line is set to achieve the expected performance levels as regards treating the patient for or preventing the development of in particular complications related to prolonged periods of being confined to bed or of being kept skill, in particular bedsores.

In another variant implementation, operation of the filling means and of the emptying means is servo-controlled to the results of the combination of the penetration distance and of the measurement of the reaction of the support device.

In a particularly advantageous other implementation of the method of the invention, a support device or mattress is provided that comprises a multitude of cushions or tubes which can be deflated individually, alternately and sequentially, in particular every other tube, one in three tubes, or one in four tubes, or one in n tubes, thereby avoiding relatively high pressures on various portions of the element to be supported, in particular the body of the patient, which are harmful to the treatment and to the comfort of certain types of patient, in particular patients who have undergone skin grafts or patients who suffer from acute pain consequent upon certain diseases.

In a second aspect, the present invention also provides apparatus for supporting an element to be supported, in particular the body of a patient, said apparatus comprising at least one support device comprising at least one closed or controlled-release chamber that is flexible and inflatable, said chamber having a top face and a bottom face, filling means and emptying means for filling said chamber with a filling fluid and emptying said fluid from said chamber, as well as distance-measurement means for measuring the distance between said top face and said bottom face, said apparatus further comprising a reaction-measurement device for measuring the reaction of the support device relative to the morphological data of the element to be supported, a control system comprising combination means for combining the measurement of the penetration distance as delivered by the distance-measurement device and the measurement of the reaction as delivered by the reaction-measurement device, so as to bring the element to be supported substantially to the position of equilibrium corresponding substantially to a predetermined "float line".

In an advantageous variant embodiment of this apparatus, the combination device of the control system sums the penetration distance measurement and the reaction measurement delivered by the reaction-measurement device.

In another variant embodiment, the reaction-measurement device comprises a pressure-measurement device for measuring the pressure in the chamber of the support device at the measured penetration distance.

In another variant embodiment, the combination device is connected to a comparator device which compares the combination value delivered by the combination device with a reference value delivered by a reference device, the reference value characterizing the equilibrium value for penetration of the element to be supported corresponding substantially to the predetermined float line of the element to be supported.

In another variant embodiment, the above-mentioned reference value that is predetermined and that defines the equilibrium corresponding substantially to the float line is set to achieve the expected performance levels as regards treating the patient for or preventing the development of in particular complications related to prolonged periods of being confined to bed or of being kept skill, in particular bedsores.

In another variant embodiment, said apparatus comprises a servo-control device for servo-controlling operation of the filling means and of the emptying means to the result of the above-mentioned combination of the penetration distance and of the measurement of the reaction as delivered by the measurement device.

In an advantageous embodiment of the invention, said apparatus comprises a support device or mattress comprising a multitude of cushions or tubes which can be deflated individually, alternately and sequentially, in particular every other tube, one in three tubes, or one in four tubes, or even one in n tubes.

It can be understood that the above-mentioned method and apparatus of the present invention solve the above-mentioned technical problems, and, in particular, make it possible in reliable and safe manner to support an element to be supported, preferably the body of patient, substantially in a position of equilibrium that corresponds substantially to a float line that is predetermined in particular as a function of the expected performance levels as regards prevention and therapy, and particularly as a function of the morphological characteristics of the immersed/apparent portion, in particular weight and body area.

BRIEF DESCRIPTION OF THE DRAWINGS

Other objects, characteristics, and advantages of the invention appear clearly on reading the following description made with reference to two currently-preferred embodiments of the invention given merely by way of illustration and therefore in no way limiting the scope of the invention. It should be noted that any characteristic that appears to be novel compared with any prior art is claimed in its genera principle. Furthermore.

In the figures:

FIG. 1 is a view in profile seen looking along arrow A in FIG. 2 and showing a support element which, in this example, is supporting a patient P1 drawn in thick lines and whose morphological characteristics are relatively larger than the morphological characteristics of a patient P2 drawn in thin lines, both patients P1 and P2 being shown in the supported state substantially in equilibrium corresponding substantially to a predetermined "float line" indicated by the dot-dash line and referenced LF;

FIG. 2 is a view similar to FIG. 1, but seen looking along arrow B in FIG. 1;

FIG. 3 is a view of a currently-preferred embodiment of support apparatus of the present invention, showing a patient P1 supported substantially in equilibrium as shown in the views of FIGS. 1 and 2, and also showing the essential means of the invention making it possible to support a patient substantially in equilibrium;

FIG. 4 shows more precisely the electronic circuit of the preferred embodiment shown in FIG. 3 and necessary to understand the present invention; and FIG. 5 is a longitudinal section view showing another particular embodiment in which the support device comprises a multitude of independent individual inflatable tubes, it being possible to make provision to deflate them individually and sequentially, every other tube, one tube in three, one in four as shown, or one in n.

MORE DETAILED DESCRIPTION

Figure 1:
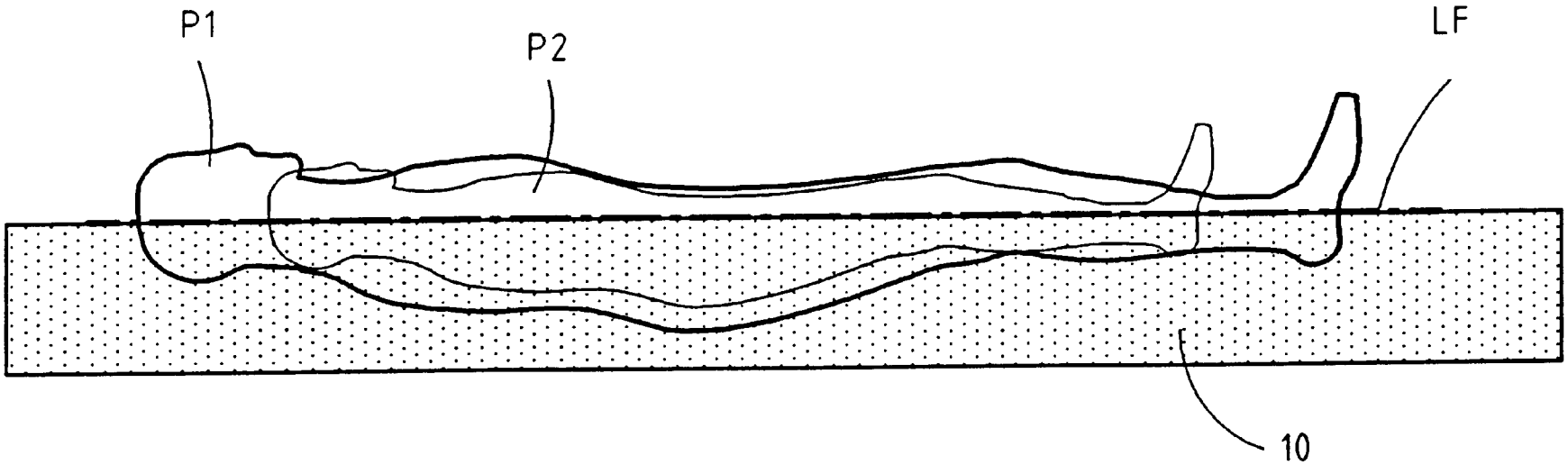
FIGS. 1 to 5 are integral parts of the present invention and therefore of the present description.
Figure 2:
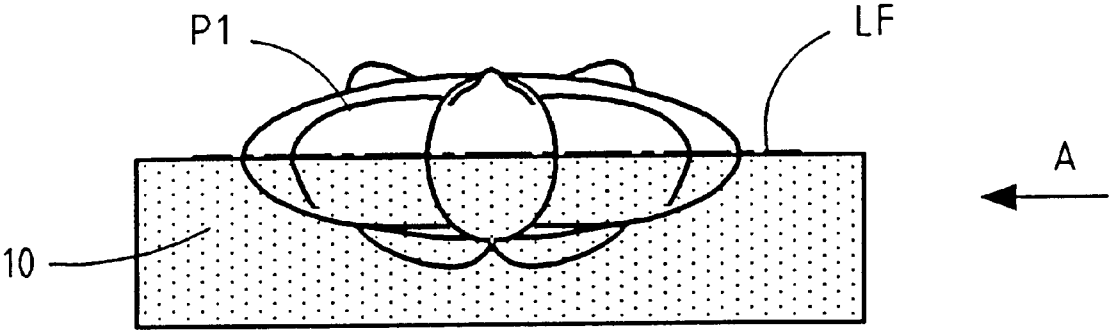
Figure 3:
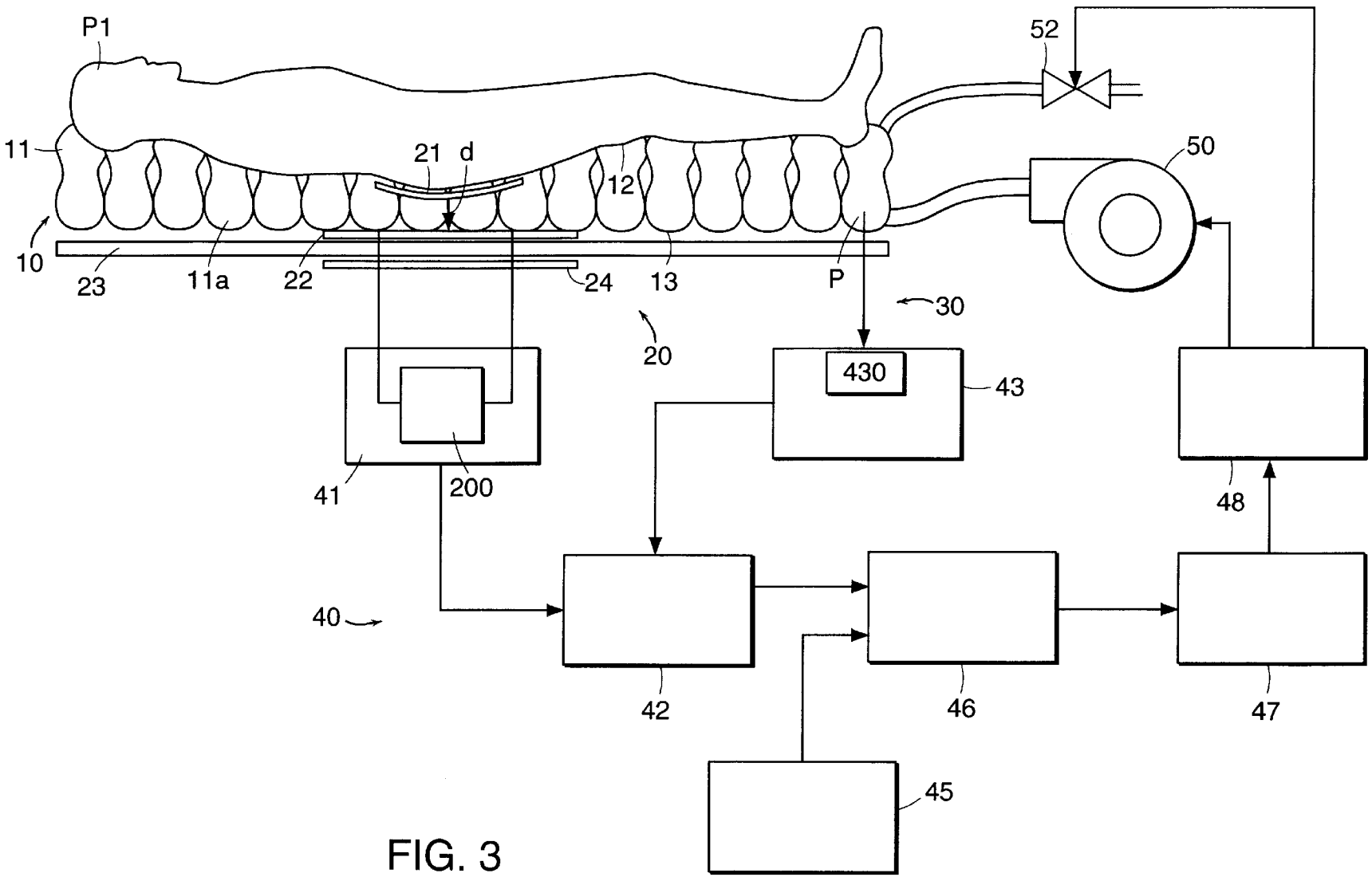

A currently-preferred embodiment of support apparatus of the present invention is shown under the overall reference 10 in FIGS. 1 to 3. This support apparatus makes it possible to support an element, in particular, as shown, the body of a patient P1, or the body of some other patient P2 having different morphological characteristics.

The apparatus 10 comprises a support device proper 11 comprising at least one closed or controlled-release chamber 11*a* that is inflatable and flexible. For example, the chamber may be made up of a multitude of inflatable tubes that communicate with one another, it being possible for said chamber 11*a* to be inflated by filling means given overall reference 50, e.g. constituted by pump means for pumping a filling fluid into said chamber. The chamber 11 has a top face 12 serving to support the element to be supported P1 or P2, and a bottom face 13 which may, for example, rest indirectly on a base (not shown) or on equivalent means.

It can be understood that the filling means 50, such as pumping means make it possible to fill the chamber 11*a* with a filling fluid, such as a gas, in particular air, or a liquid, in particular water. Emptying means 52 such as a valve for removing the fluid are also provided.

The apparatus also comprises measurement means 21 for measuring the distance d between the top face 12 of the chamber 11*a* and its bottom face 13.

According to the present invention, the apparatus further comprises a reaction measurement device 30 for measuring the reaction of the support device 11 relative to the morphological data of the element to be supported P1 or P2, as well as a control system comprising, in the context of the invention, combination means 42 for combining the penetration distance measurement delivered by the measurement device 20 with the reaction measurement delivered by the reaction measurement device 30.

In the context of the invention, the control system 40 comprising the combination device 42 uses the result of the combination of the two measurements to bring the element to be supported P1 or P2 substantially to a position of equilibrium corresponding substantially to the predetermined float line referenced LF, by acting on the filling means 50 or on the emptying means 52 as defined below.

In an advantageous variant embodiment of the apparatus of the invention, the reaction measurement device 30 comprises a pressure-measurement device 43 for measuring the pressure p in the chamber 11*a* at the measured penetration distance d.

In another advantageous variant embodiment of the apparatus of the invention, the combination device 42 of the control system 40 sums the penetration distance measurement d with the reaction measurement delivered by the reaction-measurement device 30, in particular the pressure measurement delivered by the pressure-measurement device 43.

In a preferred embodiment of the apparatus of the invention, the combination device 42 is connected to a comparator device 46 which compares the combination value delivered by a combination device 42 with a reference value delivered by a reference device 45, which reference value characterizes the equilibrium value for penetration of the element to be supported P1 or P2 corresponding substantially to the predetermined float line LF of the element to be supported P1 or P2.

The comparator device 46 compares the combination value delivered by the combination device 42 with the reference value delivered by the reference device 45, and when the result of the comparison is different from 0, the comparator device 46 transmits information to a servo-control device, e.g., as in this example, comprising a proportional-plus-integral regulation stage 47, and a control device proper 48, and servo-controlling filling or emptying of the chamber 11*a* respectively either by controlling the filling means 50 or by controlling the emptying valve 52.

It should be noted that, in the preferred embodiment shown in FIG. 3, the measurement device 20 for measuring the penetration distance d may include a metal film 21 constrained to move with the top face 12 of the support device 11, and co-operating, in this example, with an impedance-varying element 22, e.g. such as an induction coil, itself co-operating, in this example, with a shielding element 24 such as a shielding induction coil serving to guarantee that the measurement is independent of the surrounding metal mass, the positions of the impedance-varying element and of the shielding element being fixed, in this example outside the chamber 11*a*, and also having positions that are fixed relative to the bottom face 13 of the chamber 11*a*, thereby making it possible to measure the variable distance d between the variable-position metal film 21 and the fixed-position impedance-varying element 22.

It should be noted that, in this example, the impedance-varying element 22 and the shielding element 24 are integral parts of a measurement bridge 200 which is shown in detail in FIG. 4 and which is part of an electronic circuit shown clearly in FIG. 4 and described in detail below.

It should be noted that, naturally, when the difference between the combination value delivered by the combination device 42 and the reference value of the reference device 45 is zero, the point of equilibrium has been reached which corresponds substantially to the desired predetermined float line LF, and the servo-control system is no longer activated.

Figure 4B:
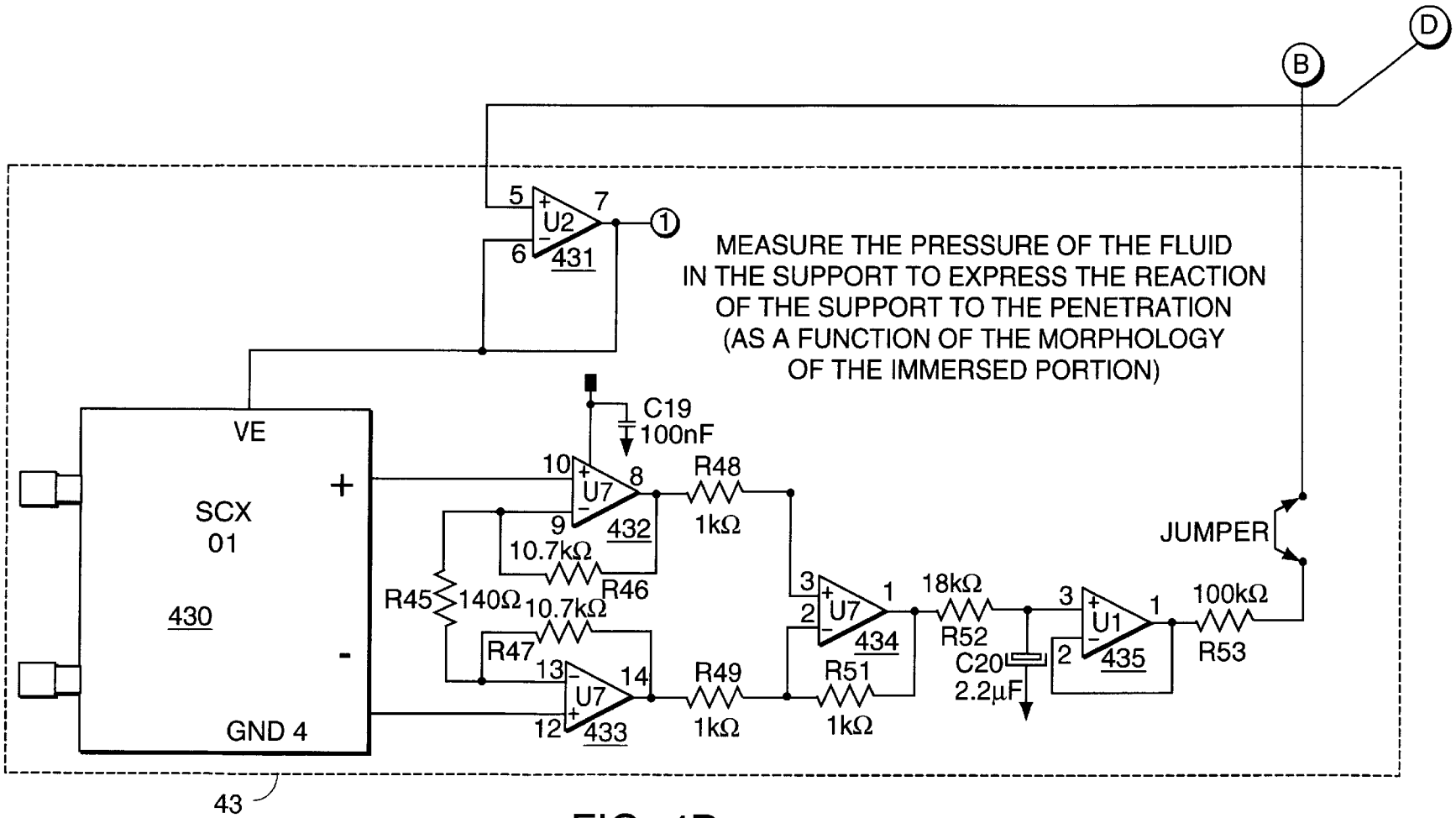
Figure 4C:
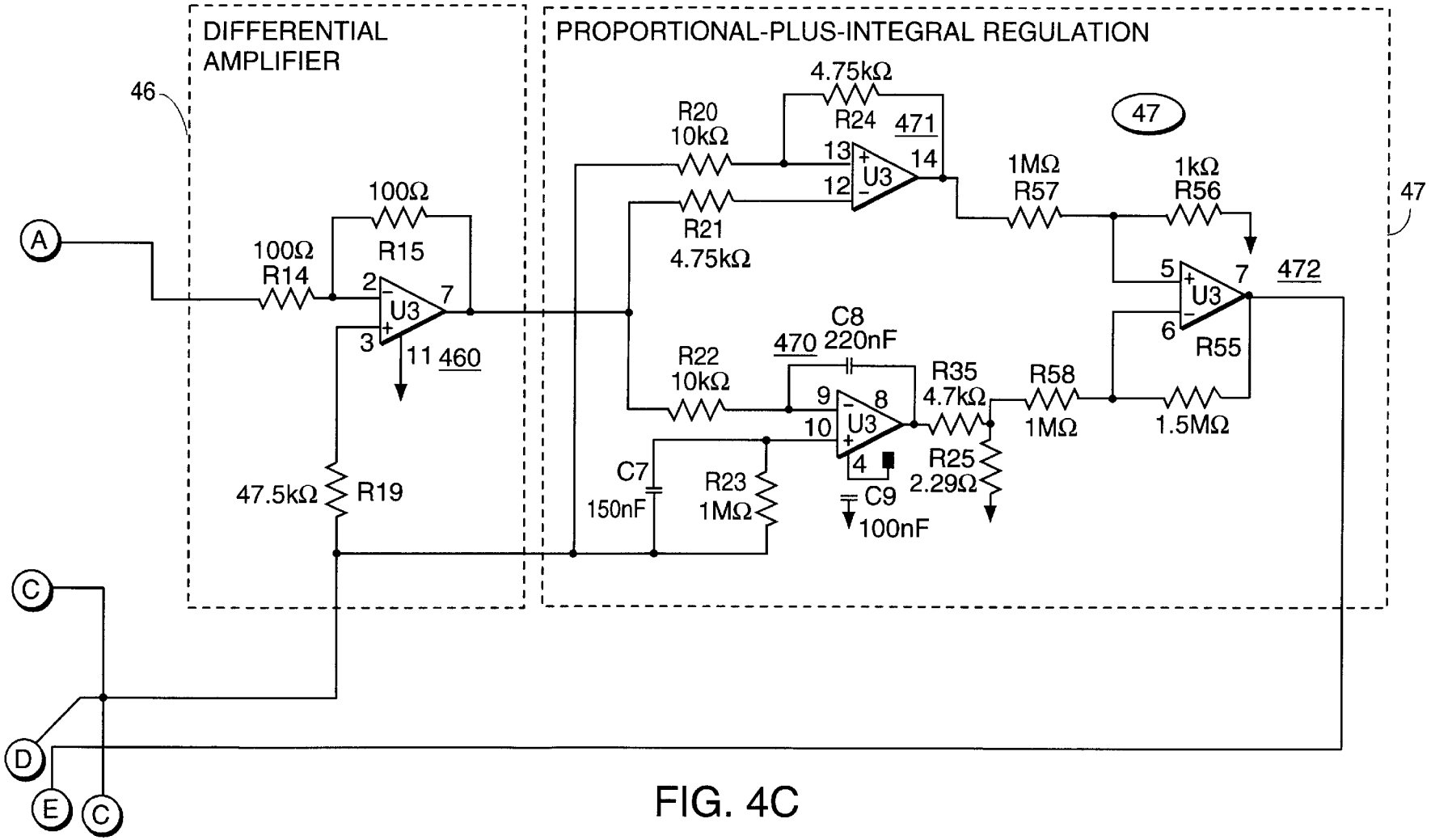
Figure 4D:
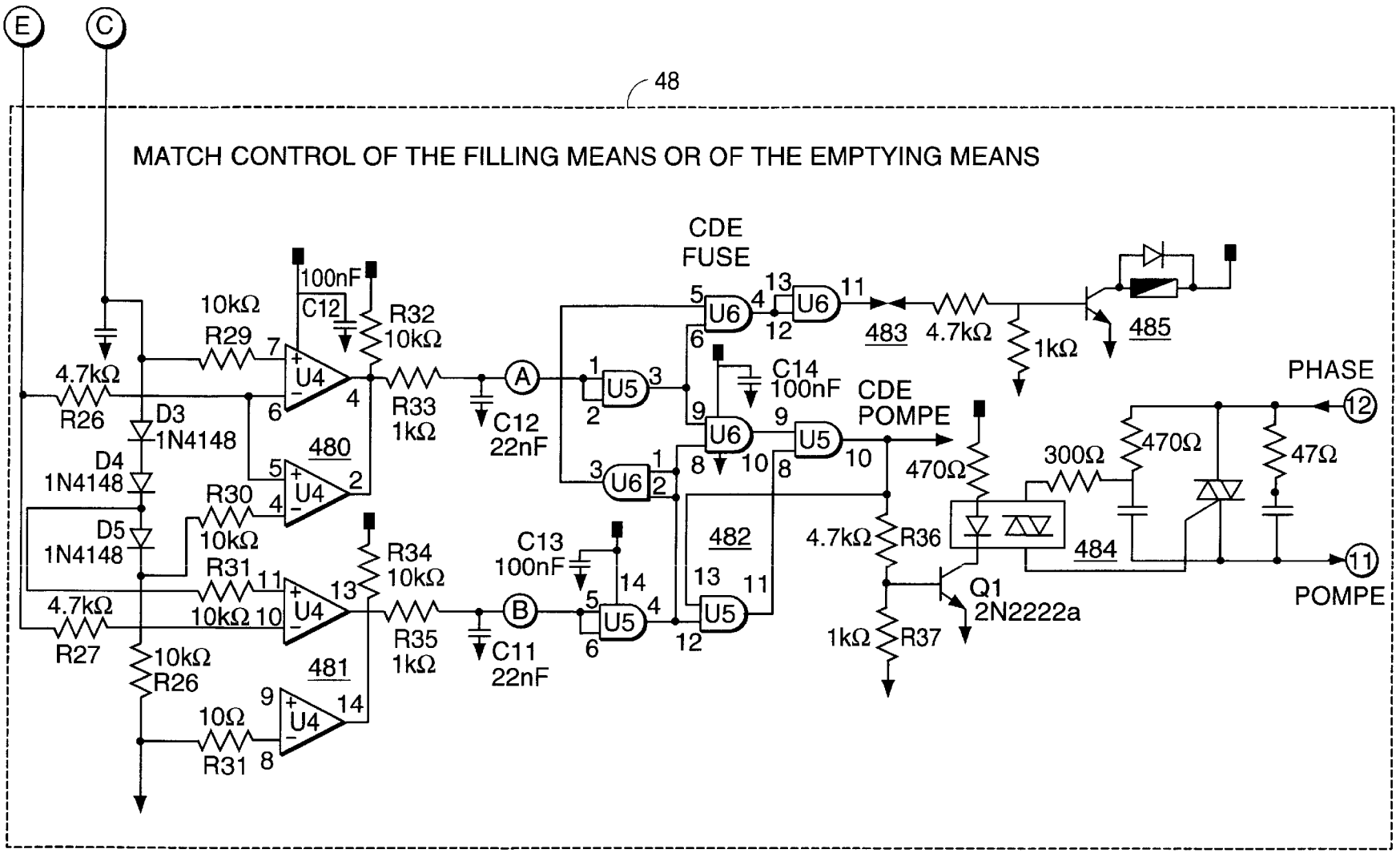

With reference to FIG. 4, a description is given below of a currently-preferred electronic circuit which implements the design of the essential members as described with reference to FIG. 3.

A person skilled in the art can easily understand that the oscillator 100 generates a sinewave signal sustained by the transistor 1001 and whose frequency is set by the inductive impedance of the measurement system 41 in parallel with the capacitive impedance of the oscillator implemented by the elements 1002 & 1003.

When the metal film 21, such as an aluminum film is closest to the impedance-varying element 22, which is a measurement induction coil 22 in this example, the measurement bridge 200 is in equilibrium. The sinewave signal entering the bridge at points 2 and 4 is distributed equally in the branches of the measurement bridge because, in this example, the measurement coil 22 and the shielding coil 24 have the same impedance. The signal between points 1 and 3 of the bridge is zero.

The further the aluminum film 21 moves away from the measurement coil 22, the more the impedance of the measurement coil 22 differs from the fixed impedance of the shielding coil 24, and so the signal is distributed unequally in the branches of the bridge, and a sinewave signal appears at terminals 1 and 3.

This sinewave signal is transformed into a DC voltage by the diode 414 and the capacitor 415 via an impedance matcher 413.

The Reference Device 45

A fixed voltage reference, which is generated by the operational amplifier 450 serves as a reference for processing performed by the regulation system.

The Pressure Measurement Device 43

A pressure sensor 430 disposed at an appropriate place in the support element (a mattress in the example) and associated with a specific power supply implemented by the element 431 delivers a DC voltage that is proportional to the air pressure in the mattress.

Given that the mattress is a closed casing, pressure variations are the images of the reactions of the support to the penetration of the patient, the electrical image of said penetration being delivered by means of the measurement induction coil 22 integrated in a measurement device 41 comprising the above-described measurement bridge 200.

The elements 432, 433, and 434 amplify the signal to give it a value that is consistent with the signal delivered by means of the measurement device 41 having an induction coil 22 integrated in the bridge 200.

435 is an impedance matcher.

The Aadjustment Setpoint Device 44

The adjustment setpoint device 44 gives a DC voltage that is adjusted by means of the potentiometer 440. This adjustment is provided to compensate for any dispersions.

The Summing Circuit 42

A summing circuit 42 implemented with an operational amplifier 420 gives an output voltage equal to the sum of the three DC voltages processed by 41, 43, and 44. At the point of equilibrium, this sum is equal to the reference voltage entering the differential amplifying stage 46 described below.

The variables p and d are the inputs of a summing circuit whose result (or output) is a constant:

p=pressure or reaction of the support, output by 43;

d=penetration distance to which the patient penetrates, output by 41; and p+d=Cte=reference voltage. Thus, depending on the morphology of the patient or on the position of the patient, the proportions of p (pressure) and of d (penetration distance) are different to obtain the constant at the regulation point.

Differential Amplifier 46

A differential amplifier 46 implemented with an operational amplifier 460 gives an output voltage equal to twice the reference voltage minus the output voltage of the summing circuit 42. At the regulation point, this voltage is equal to the reference voltage. If the system is not at its point of equilibrium, the output is equal to the reference voltage plus or minus the voltage proportional to the difference.

The Proportional-plus-integral Device 47

The proportional-plus-integral Device 47 serves to amplify the difference measured at 46 while damping sudden variations in the differences in order to avoid hunting phenomena or unwanted changes in operating state. 471 measures the difference, and 470 is an integrator which damps the variations in the difference. The outputs of these two elements are applied to 472 which amplifies the difference proportionally to its duration.

The Control Device 48 for Controlling the Filling Means or the Emptying Means The control device 48 comprises two window comparators which define a low lift range 480 and a high lift range 481. The two lift ranges overlap. The zone common to both ranges is the optimum lift zone and corresponds to the value output from 47.

When the output from 47 decreases towards the low zone, the output "A" from 480 changes state, and the logic system 482 causes filling to start via the control 484 which actuates the pumping means 50. Conversely, when the output 47 increases towards the high zone, the output "B" of 481 changes state, and the logic system 483 causes emptying to start via the control 485 which actuates the emptying valve 52.

Figure 5:
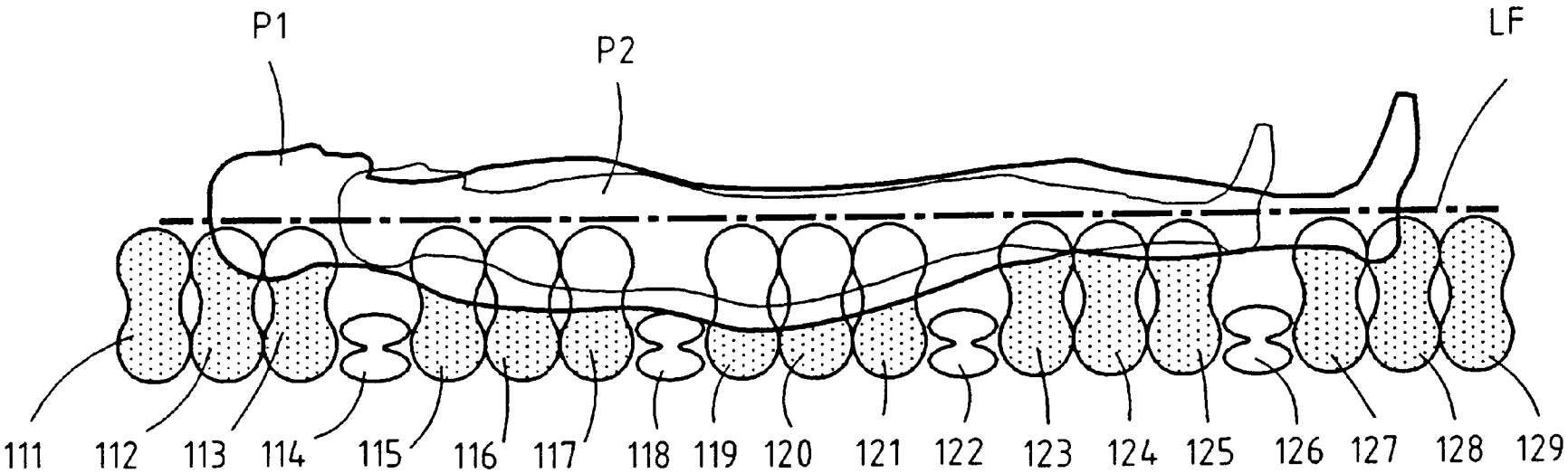

FIG. 5 shows a particularly advantageous embodiment of the invention that is applicable in the context of an "alternating pressure mode", with a support device or mattress comprising a multitude of cushions or tubes 111, 112, 113, 114 to 129 which can be individually deflated alternately and sequentially. Such sequential deflation may be performed on every other tube, on one in three tubes, or on one in four tubes as shown in FIG. 4, for the tubes or cushions 114, 118, 122, 126, or even on one in five tubes or on one in n tubes. In this context, the invention, which makes it possible to find a support equilibrium substantially along the float line, offers a decisive advantage by making it possible to avoid relatively high pressures on various portions of the body that are harmful to treatment, e.g. for skin grafts, or to comfort. By obtaining a constant equilibrium substantially on the float line, the invention makes it possible to maintain a pressure that is lower than the non-vascularization pressure during the stages in which the tissues are subjected to the pressure exerted by the therapeutic surface during alternating operating of the type shown in FIG. 5.

In other words, by means of the low pressures that are obtained by the method and apparatus of the present invention, it is possible for patients who have, for example, bedsores, regardless of whether they have undergone skin grafts, to be treated with optimum comfort, by putting the patient in a "floating" state in the therapeutic surface.

We claim:

1. A method of supporting an element, comprising the steps of providing at least one support device comprising at least one closed or controlled-release chamber that is flexible and inflatable, said chamber having a top face and a bottom face, providing distance-measurement means for measuring a distance between said top face and said bottom face, providing a reaction-measurement device for measuring a reaction of the support device relative to morphological data of the element, penetrating said at least one chamber by the element, measuring the distance between said top face and said bottom face of said at least one chamber, measuring the reaction of the support device to said penetration of the element, combining the measured reaction of the support device to said penetration of the element with the measured distance between said top face and said bottom face, and bringing, based on said combining, the element substantially to a position of equilibrium corresponding substantially to a predetermined float line by filling or emptying said at least one chamber with a fluid.

2. The method of claim 1, wherein said combining step includes summing the measured distance and the measured reaction.

3. The method of claim 1, wherein said measuring step the reaction of the support device includes measuring the pressure in said chamber at said measured distance.

4. The method of claim 3, wherein said combining step includes summing the measured distance and the measured pressure in the chamber.

5. The method of claim 1, wherein said bringing step includes comparing the combination of the measured distance and the measured reaction with a reference value characterizing the equilibrium value for said penetration of the element corresponding substantially to the predetermined float line of said element.

6. The method of claim 5, wherein said bringing step includes predetermining the reference value that defines the equilibrium corresponding substantially to the float line by selecting a value characteristic of optimum pressures applied to an area of the body in contact with the support device, so as to achieve expected performance levels as regards treating patient for or preventing the development of in particular complications related to prolonged periods of being confined to bed or of being kept skill, in particular bedsores.

7. The method of claim 1, wherein said filling is performed by an inflation device being servo-controlled to the results of the above-mentioned combination of the measured distance and the measured reaction of the support device.

8. The method of claim 1, wherein said step of penetrating by the element is penetrating by a body of a patient, in particular a patient who as undergone a skin graft, or a patient who is suffering from skin lesions such as bedsores.

9. The method of claim 1, wherein said filling and emptying includes inflating or deflating a multiplicity of tubes individually, alternately and sequentially.

10. An apparatus for supporting an element, comprising at least one support device comprising at least one closed or controlled-release chamber that is flexible and inflatable, said chamber having a top face and a bottom face, filling means and emptying means for filling said chamber with a filling fluid and emptying said fluid from said chamber, respectively, a distance-measurement device for measuring the distance between said top face and said bottom face, a reaction-measurement device for measuring a reaction of the support device relative to morphological data of the element, and a control system comprising a combination device for combining the distance measured by the distance-measurement device and the reaction measured by the reaction-measurement device, said control system being arranged to control said filling and emptying means so as to bring the element substantially to a position of equilibrium corresponding substantially to a predetermined float line.

11. The apparatus of claim 10, wherein the combination device of the control system sums the measured distance and the measured reaction.

12. The apparatus of claim 10, wherein the reaction-measurement device comprises a pressure-measurement device for measuring pressure in the chamber of the support device.

13. The apparatus of claim 10, wherein the combination device is connected to a comparator device which compares the combination value provided by the combination device with a reference value provided by a reference device, the reference value characterizing the equilibrium for penetration of the element corresponding substantially to the predetermined float line of the element.

14. The apparatus of claim 13, wherein the element is a patient and the reference value is set to a value characteristic of optimum pressures applied to an area of the body of the patient in contact with the support device for treating the patient for, or preventing the development of, particular complications related to prolonged periods of being confined to bed or of being kept still.

15. The apparatus of claim 10, comprising a servo-control device for servo-controlling operation of the filling means and of the emptying means to the result of the combination of the measured distance and of the measured reaction.

16. The apparatus of claim 10, wherein said support device comprises a multitude of cushions or tubes which can be deflated individually, alternately and sequentially in the order as one of the following every other tube, one in three tubes, or one in four tubes, or even one in n tubes.

17. The apparatus of claim 10, wherein the element is a patient and the support device includes a mattress for supporting the patient who as undergone a skin graft, or the patient who is suffering from skin lesions.

18. The apparatus of claim 10, wherein the element is a patient and the support device includes a mattress for supporting the patient who is suffering from bedsores.

* * * * *